US011644021B2

(12) United States Patent
Keatch

(10) Patent No.: US 11,644,021 B2
(45) Date of Patent: May 9, 2023

(54) SCREW PUMP AND METHOD OF USE

(71) Applicant: Richard William Keatch, Fife (GB)

(72) Inventor: Richard William Keatch, Fife (GB)

( * ) Notice: Subject to any disclaimer, the term of this patent is extended or adjusted under 35 U.S.C. 154(b) by 0 days.

(21) Appl. No.: 17/290,887

(22) PCT Filed: Oct. 25, 2019

(86) PCT No.: PCT/GB2019/053041
§ 371 (c)(1),
(2) Date: May 3, 2021

(87) PCT Pub. No.: WO2020/095024
PCT Pub. Date: May 14, 2020

(65) Prior Publication Data

US 2022/0003223 A1 Jan. 6, 2022

(30) Foreign Application Priority Data

Nov. 7, 2018 (GB) ..... 1818140

(51) Int. Cl.
*F04B 19/12* (2006.01)
*F04B 19/06* (2006.01)

(52) U.S. Cl.
CPC ..... *F04B 19/12* (2013.01); *F04B 19/06* (2013.01)

(58) Field of Classification Search
CPC .... F04C 2/107–113; F01D 1/38; F01C 13/04; F03B 17/061; F05B 2240/372; F04B 19/12; F04D 3/02
USPC ..... 417/327, 334, 336, 94; 415/71–74
See application file for complete search history.

(56) References Cited

U.S. PATENT DOCUMENTS 1,610,454 A * 12/1926 Lawaczeck ..... F04D 29/0413 417/406
1,714,330 A * 5/1929 Tucker ..... F04D 3/02 417/91
2,100,560 A * 11/1937 Kennedy ..... F04C 13/008 417/406
2,113,213 A * 4/1938 Leonard ..... F04D 13/043 417/247
3,330,213 A * 7/1967 Donaldson ..... F04D 13/043 417/373
4,143,999 A * 3/1979 Ryall ..... F04D 1/14 416/177
4,146,353 A * 3/1979 Carrouset ..... F04D 3/02 416/179

(Continued)

FOREIGN PATENT DOCUMENTS

CN 207006628 U 2/2018
JP 60-212690 A 10/1985

(Continued)

OTHER PUBLICATIONS

International Search Report and Written Opinion for PCT/GB2019/053041 dated Feb. 19, 2020.

*Primary Examiner* — Thomas Fink
(74) *Attorney, Agent, or Firm* — FisherBroyles, LLP

(57) ABSTRACT

The invention provides a fluid pump apparatus comprising a fluid inlet, a fluid outlet, a screw member and a rotatable pump member. The screw member has at least one helical screw blade configured to be rotated by a fluid flow stream and the rotatable pump member is in fluid communication with the fluid inlet and/or fluid outlet.

25 Claims, 11 Drawing Sheets

(56) References Cited

U.S. PATENT DOCUMENTS

| | | | | | |
|---|---|---|---|---|---|
| 4,228,658 | A * | 10/1980 | Belcher | F01K 27/005 | 415/75 |
| 4,913,631 | A * | 4/1990 | Vandendorpe | F04C 11/006 | 417/91 |
| 5,139,391 | A * | 8/1992 | Carrouset | B63H 5/14 | 416/177 |
| 5,217,051 | A * | 6/1993 | Simpson | F04D 25/026 | 141/46 |
| 5,295,810 | A * | 3/1994 | Heijnen | F04D 31/00 | 417/408 |
| 5,316,449 | A * | 5/1994 | Vandendorpe | F04D 13/043 | 417/409 |
| 10,087,907 | B2 | 10/2018 | Fjälling | | |
| 2010/0043424 | A1* | 2/2010 | Papadopoulos | F03B 13/1865 | 60/498 |
| 2011/0085907 | A1* | 4/2011 | Anderson | F03B 3/126 | 29/889.7 |
| 2012/0117960 | A1 | 5/2012 | Browne | | |
| 2016/0201283 | A1 | 7/2016 | Fjälling | | |
| 2018/0142695 | A1* | 5/2018 | Tomaru | F04D 1/025 | |

FOREIGN PATENT DOCUMENTS

| | | | |
|---|---|---|---|
| JP | 2012090619 | A | 5/2012 |
| WO | WO2012/101655 | A2 | 8/2012 |

* cited by examiner

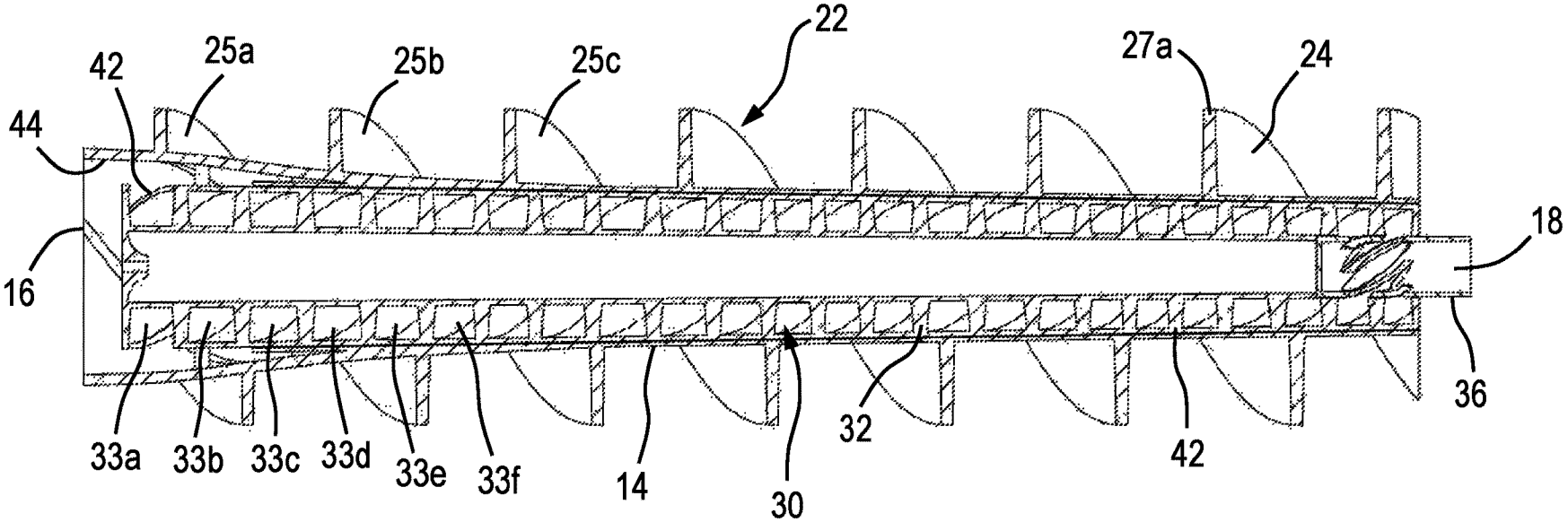
Fig. 2
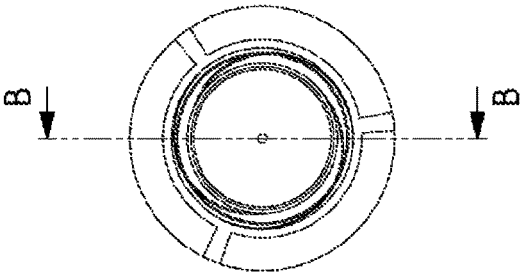

SCREW PUMP AND METHOD OF USE

This application is the U.S. National Stage of International Application No. PCT/GB2019/053041, which was filed on Oct. 25, 2019. This application also claims the benefit of the filing date of GB patent application No. 1818140.4, which was filed on Nov. 7, 2018. The contents of both of those applications are hereby incorporated by reference.

The present invention relates to fluid pump systems, in particular positive displacement pump systems. Aspects of the invention include a method of pumping fluids that finds particular application in displacing water for farmland irrigation and during flood control operations.

BACKGROUND TO THE INVENTION

Screw pumps such as Archimedes' screw pumps are well-known. These pumps comprise a threaded screw of helical blades mounted on a central shaft. Typically, the threaded screw is mounted inside a cylindrical tube which is open at both ends. The shaft is rotated using either a hand crank or an electric motor.

In use, the Archimedes' screw pump is inclined to the horizontal where one end is submerged underwater and an elevated end rises above the level of the water. As the threaded screw revolves water or other pumpable liquid/material is repeatedly scooped into the lower open end of the screw and forms a series of wells of water in the spaces between the surface of the inner cylindrical tube and the helical blades. As the screw rotates the wells of water are repeatedly taken in and slowly raised with each revolution until the wells of water reach the upper end of the screw. The elevated fluid is then discharged through the upper opening.

Archimedes' screw pumps are an ancient type of fluid displacement pump which are still used today in underdeveloped countries of the world. However large steel versions of these pumps are today used in dam structures to raise water from rivers or lakes onto adjacent irrigated farmland or conversely, are used to generate electricity by allowing the water at the elevated end of the screw to flow down the screw and rotate it thereby turning a generator.

Conventional Archimedes' screw pumps are not suitable for displacing flood water from all low-lying river types. These pumps require a supporting dam structure in place to allow the pump to be held partially submerged in an inclined position in order to operate.

The challenging conditions posed by swollen rivers under turbulent flow flood conditions can also restrict the location that conventional pumps may be used. Solid material in flood water such as particulate mud, sand, grit, rocks and pebbles together with floating materials such as reeds and branches can reduce the effectiveness of these pumps in flood control operations.

SUMMARY OF THE INVENTION

It is an object of an aspect of the present invention to obviate or at least mitigate the foregoing disadvantages of prior art fluid pump systems.

It is another object of an aspect of the present invention to provide a screw pump apparatus with improved productivity and/or efficiency which is capable of reliably displacing fluid in horizontal, vertical and inclined configurations.

It is a further object of an aspect of the present invention to provide a fluid pump system which allows the pump to operate in flowing water without the requirement of an external power supply.

Further aims of the invention will become apparent from the following description.

According to a first aspect of the invention, there is provided a fluid pump apparatus comprising a fluid inlet;

a fluid outlet;

a screw member having at least one helical blade; and a rotatable pump member;

wherein the screw member is located on an exterior surface of the fluid pump apparatus.

The rotatable pump member may be in fluid communication with the inlet and/or the outlet. The screw member and the rotatable pump member may be arranged to rotate around different rotational axes. The screw member and the rotatable pump member may be arranged to rotate around parallel rotational axes.

The screw member and the rotatable pump member may be arranged co-axially.

The screw member and the rotatable pump member may be located on the same axis and rotatable about the same axis. The screw member and the rotatable pump member may be rotationally coupled. The screw member and the rotatable pump member may be configured to rotate in the same rotational direction. The screw member and the rotatable pump member may be arranged concentrically.

The screw member may be configured to rotate and/or drive the rotation of the apparatus about a longitudinal axis of the apparatus. The rotatable pump member may be configured to pump or displace fluid when it is rotated.

Preferably the screw member comprises two or more helical blades. The screw member may comprise three or more helical blades. Preferably the screw member is an outer screw member.

The rotatable pump member may be selected from the group comprising at least one screw member, Wirtz pump, a coil pump, a coil tube or a spiral pump.

Preferably the rotatable pump member is at least one screw member. The at least one screw member may have at least one helical screw blade.

Preferably the rotatable pump member is at least one inner screw member. The rotatable pump member may comprise a plurality of inner screw members.

Preferably the at least one inner screw member comprises two or more helical blades. The at least one inner screw member may comprise three or more helical blades.

The outer screw member and the at least one inner screw member may be rotationally coupled. The outer screw member and at least one inner screw member may be configured to rotate in the same rotational direction.

Preferably the at least one helical blade of the outer screw member has a first thread direction. Further preferably the at least one blade of the at least one inner member has a second thread direction. The first thread direction and the second thread direction may be in opposing directions, the first thread direction and second thread direction may be contra-directional.

The at least one helical blade of the at least one inner screw member may be in an opposing direction to the at least one helical screw blade of the outer screw member.

The outer screw member and the at least one inner screw member may be arranged concentrically. The outer screw member and the at least one inner screw member may be configured to co-rotate in the same direction around the same axis.

Preferably the outer screw member is configured to contact a fluid flow stream. The first thread direction of the outer screw member may be configured to rotate the fluid pump apparatus around its longitudinal axis when exposed to a fluid flow.

The at least one inner screw member may be located on an interior surface of the fluid pump apparatus. The at least one inner screw member may be located on or in a sleeve mountable on an interior surface of the fluid pump apparatus. The at least one inner screw member may be a plurality of screws located on or in a sleeve mountable on an interior surface of the fluid pump apparatus.

The at least one inner screw may be configured to be in contact with fluid flow stream. The thread of the at least one inner screw may be configured to generate a flow or movement of fluid along an axial length of the at least one inner screw member when the at least one inner screw is rotated.

The at least one inner screw member may be located internally in a central channel or tube with the outer screw member located outside the at least one inner screw member.

The outer screw member may be a right-hand screw and the at least one inner screw member may be a left-hand screw. The outer screw member may be a left-hand screw and the at least one inner screw member may be right hand screw.

Preferably, the screw rotation is synchronous, such that rotation of the outer screw member rotates the at least one inner screw member in same direction.

A fluid flow stream acting upon the outer screw member in a first flow direction may rotate the at least one inner screw member and create a flow of fluid in a second flow direction. The first flow direction and the second flow direction may be opposing flow directions.

The direction of flow of the first flow direction and/or the second flow direction depends on whether the inlet is upstream or downstream of the outlet. The inlet may be located downstream of the outlet. The outlet may be located downstream of the inlet.

The fluid pump apparatus may comprise a body or casing configured to contact a water flow stream. The screw member may be located on an exterior surface of the body or casing.

The at least one inner screw member may be located on an interior surface of the body or casing. The at least one inner screw member may be located in or on a tube or sleeve connected to an interior surface of the body or casing.

The inlet may be located at a first end of the body and the outlet is located at a second end. The inlet and outlet may be axially spaced apart along the longitudinal axis of the body.

The body may converge or taper along its longitudinal axis. The body may conically converge toward the outlet.

The fluid pump apparatus may be used to pump and/or transport water in irrigation systems or flood control systems.

According to a second aspect of the invention, there is provided a fluid pump apparatus comprising a fluid inlet;

a fluid outlet;

a screw member and a rotatable pump member;

wherein the screw member has at least one helical screw blade configured to be rotated by a fluid flow stream; and wherein the rotatable pump member is in fluid communication with the fluid inlet and/or fluid outlet.

The screw member and the rotatable pump member may be arranged concentrically. The screw member and the rotatable pump member may be arranged co-axially. The screw member screw and the rotatable pump member screw may be configured to co-rotate in the same or opposing direction around the same axis.

The rotatable pump member may be selected from the group comprising, Wirtz pump, at least one screw, a coil pump, a coil tube or a spiral pump.

The rotatable pump member may be at least one screw member having at least one helical screw blade. Preferably the at least one screw member is at least one inner screw member. The at least one inner screw member may comprise two or more helical blades. The at least one inner screw member may comprise three or more helical blades.

Embodiments of the second aspect of the invention may include one or more features of the first aspect of the invention or its embodiments, or vice versa.

According to a third aspect of the invention, there is provided a fluid pump apparatus comprising a fluid inlet;

a fluid outlet;

a first screw member having at least one helical blade; and a second screw member having at least one helical blade;

wherein the second screw member is in fluid communication with the inlet and/or the outlet; and wherein the first screw and second screw members are configured such that rotation of the first screw member rotates the second screw member.

The first screw member may be an outer screw member. The second screw member may be at least one inner screw member.

Embodiments of the third aspect of the invention may include one or more features of the first or second aspects of the invention or their embodiments, or vice versa.

According to a fourth aspect of the invention, there is provided a method of pumping a fluid, the method comprising providing a fluid pump apparatus comprising:

a fluid inlet;

a fluid outlet;

a screw member having at least one helical blade;

a rotatable pump member;

wherein the rotatable pump member is in fluid communication with the inlet and the outlet; exposing the apparatus to a body of moving fluid to rotate the screw member; and;

moving fluid from the fluid inlet to the fluid outlet through the rotatable pump member.

The screw member and the rotatable pump member may be arranged co-axially. The screw member and rotatable pump member may be located on the same axis and rotatable about the same axis.

The rotatable pump member may be selected from the group comprising at least one screw member, Wirtz pump, a coil pump, a coil tube or a spiral pump.

Preferably the rotatable pump member is at least one inner screw member having at least one helical screw blade.

The method may comprise submerging or at least partially submerging the apparatus in the body of moving fluid. Preferably the fluid is water.

The method may comprise pumping the fluid in an irrigation or flood control operation.

Embodiments of the fourth aspect of the invention may include one or more features of the first to third aspects of the invention or their embodiments, or vice versa.

According to a fifth aspect of the invention, there is provided a method of pumping a fluid, the method comprising providing a fluid pump apparatus comprising:

a fluid inlet;

a fluid outlet;

a first screw member having at least one helical blade;

a second screw member having at least one helical blade;

wherein the second screw member is in fluid communication with the inlet and/or the outlet;

exposing the fluid pump apparatus to a body of moving fluid to rotate the first screw member; and moving fluid from the fluid inlet to the fluid outlet along the second screw member.

Preferably, the first screw member and second screw member are arranged co-axially.

The method may comprise submerging or at least partially submerging the apparatus in the body of moving fluid. Preferably the fluid is water.

Preferably, the rotational movement of the first screw member and the second screw member is synchronous, such that rotation of the first screw rotates the second screw.

Preferably the first screw member and the second screw member are configured such that a flow stream acting upon the first screw member in a first flow direction rotates the second screw and creates a flow of fluid in a second flow direction. The first flow direction and the second flow direction may be opposing flow directions. The first flow direction and the second flow direction may be in the same direction.

The method may comprise inclining the apparatus relative to a horizontal and/or vertical plane so that the fluid outlet is higher than the fluid inlet.

Embodiments of the fifth aspect of the invention may include one or more features of the first to fourth aspects of the invention or their embodiments, or vice versa.

According to a sixth aspect of the invention, there is provided a method of pumping a fluid substantially horizontally method comprising providing a fluid pump apparatus comprising a fluid inlet;

a fluid outlet;

a first screw member having at least one helical blade;

a rotatable pump member;

wherein the rotatable pump member is in fluid communication with the inlet and the outlet; exposing the apparatus to a body of moving fluid to rotate the first screw member; and moving fluid from the fluid inlet to the fluid outlet via the rotatable pump member.

The rotatable pump member may comprise threads. The method may comprise moving fluid along threads of the rotatable pump member.

Preferably, the first screw member and rotatable pump member are arranged co-axially; The method may comprise forming discrete air and water pockets in each thread of the rotatable pump member. The method may comprise moving consecutive pockets of air and water along the rotatable pump member from the inlet to the outlet.

The method may comprise building pressure within the discrete air pockets and creating a head of water.

The method may comprise compressing the air pockets as the consecutive pockets of air and water move along the rotatable pump member from the inlet to the outlet. The rotatable pump member may be configured to have a decreasing internal volume from the inlet to the outlet so that the discrete air pockets within each rotation occupies a progressively decreasing volume along the longitudinal length of the rotatable member.

Embodiments of the sixth aspect of the invention may include one or more features of the first to fifth aspects of the invention or their embodiments, or vice versa.

According to a seventh aspect of the invention, there is provided a method of pumping a fluid substantially horizontally method comprising providing a fluid pump apparatus comprising a fluid inlet;

a fluid outlet;

a first screw member having at least one helical blade;

a second screw member having at least one helical blade;

wherein the second screw member is in fluid communication with the inlet and the outlet; exposing the apparatus to a body of moving fluid to rotate the first screw member; and moving fluid from the fluid inlet to the fluid outlet along the second screw member.

The fluid may be moved along the threads of the at least one helical blade of the second screw member.

Preferably, the first screw member and second screw member are arranged co-axially; The method may comprise forming discrete air and water pockets in each thread of the screw. The method may comprise moving consecutive pockets of air and water along the second screw from the inlet to the outlet.

The method may comprise building pressure within the discrete air pockets and creating a head of water.

The method may comprise compressing the air pockets as the consecutive pockets of air and water move along the second screw member from the inlet to the outlet. The second screw member may be configured to have a decreasing internal volume from the inlet to the outlet so that the discrete air pockets within each rotation occupies a progressively decreasing volume along the longitudinal length of the second screw member.

Embodiments of the seventh aspect of the invention may include one or more features of the first to sixth aspects of the invention or their embodiments, or vice versa.

According to an eighth aspect of the invention, there is provided an irrigation system comprising a fluid pump apparatus comprising a fluid inlet;

a fluid outlet;

a screw member having at least one helical blade; and a rotatable pump member;

wherein the screw member is located on an exterior surface of the fluid pump apparatus.

Embodiments of the eighth aspect of the invention may include one or more features of the first to seventh aspects of the invention or their embodiments, or vice versa.

According to a ninth aspect of the invention, there is provided a flood control system comprising a fluid pump apparatus comprising a fluid inlet;

a fluid outlet;

a screw member having at least one helical blade; and a rotatable pump member;

wherein the screw member is located on an exterior surface of the fluid pump apparatus.

Embodiments of the ninth aspect of the invention may include one or more features of the first to eighth aspects of the invention or their embodiments, or vice versa.

BRIEF DESCRIPTION OF THE DRAWINGS

There will now be described, by way of example only, various embodiments of the invention with reference to the following drawings (like reference numerals referring to like features) in which:

FIG. 2 shows a sectional drawing of a screw pump apparatus of FIG. 1 with an insert sleeve in accordance with an embodiment of the present invention;

DETAILED DESCRIPTION OF PREFERRED EMBODIMENTS

Figure 1:
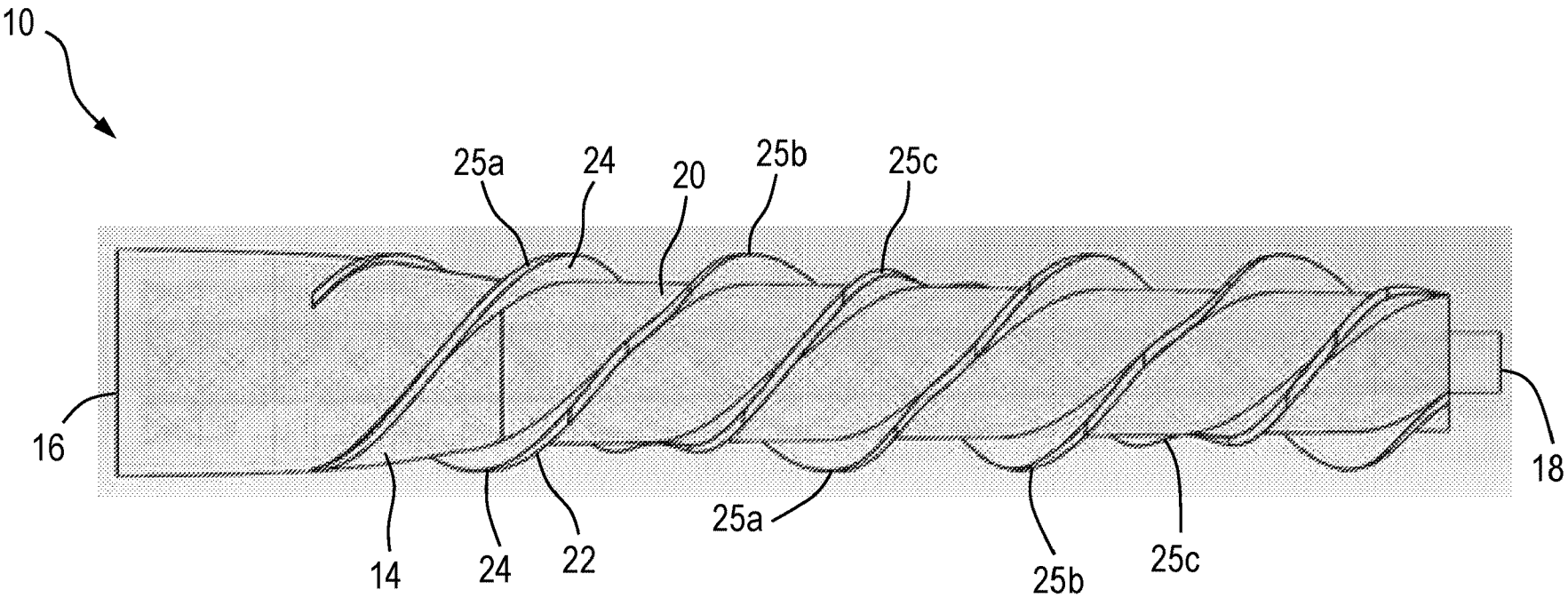
FIG. 1 presents a screw pump apparatus in accordance with an embodiment of the present invention, shown in side view.

FIG. 1 presents a screw pump apparatus in accordance with an embodiment of the present invention. The apparatus 10 comprises a body 14, a fluid inlet 16 and a fluid outlet 18. The body 14 has a generally cylindrical outer surface 20 and an outer screw 22 formed from a plurality of helical blades 24 located on the outer surface 20. The blades 24 may be fixed to or integral with the outer surface 20.

The apparatus 10 is configured to rotate around its longitudinal axis when a fluid passes over the outer surface 20 and the outer screw 22. In this example three blades 25*a*, 25*b* and 25*c* are located on the outer surface 20 in a helical threaded arrangement.

FIG. 2 shows a cross-sectional view of the apparatus of FIG. 1 along line B-B'. As best shown in FIG. 2 an inner screw 30 is located inside the body 14. The inner screw 30 is configured to be in fluid communication with the fluid inlet via fluid inlet channel 16 and fluid outlet 18. The fluid inlets are openings around the circumference of the body 14 (not shown). The inner screw 30 is formed from a plurality of helical blades 32 located inside of the body 14.

In this example six blades 33*a* to 33*f* are located in an inner sleeve 42. The outer screw 22 and the inner screw 30 are co-axial and are rotationally coupled. The inner screw 30 of opposite thread direction is contained within the outer body 14 and is separated from the outer screw 22. The thread direction of the outer screw 22 and inner screw 30 have opposing directions. The two screws 22, 30 are attached to each other to form a single rotating assembly.

In use, the apparatus 10 is positioned in a body of water. The apparatus 10 may be operated on a gradient or inclined configuration by providing a supporting structure (not shown). This allows a lower end of the apparatus 10 to be partially submerged at the lower water level and the upper end of this screw to rise above the level of the water at the dam. The outer screw 22 is exposed to flowing water from the upper level.

The lower end adjacent to the inlet 16 of the internal screw is half-submerged in water and as it rotates the inlet 16 is immersed in water for a half rotation and then exposed to air for the other half rotation before being submerged once more in the water to take in more water.

A flow stream acts upon blades 25*a*, 25*b* and 25*c* of the outer screw driving their rotation about the longitudinal axis and rotating the apparatus 10. Water enters the inner screw 30 through the fluid inlet 16. As the apparatus 10 and inner screw 30 are rotated, the blades 33*a* to 33*f* of the inner screw acts on the water and moves the water along the longitudinal axis of the inner screw 30 towards the outlet 18. The water exits the apparatus 10 through outlet 18 and connected pipe 36.

By providing two coaxial rotationally coupled screws 22, 30 having different screw directions on the apparatus, the pumping of water from the inlet 16 to the outlet 18 by the inner screw 30 in the apparatus is powered by the flowing water acting on the outer screw.

As shown in FIG. 2 the blades 32 of the inner screw 30 are mounted in a sleeve 42, the sleeve 42 is mounted or fixed to the inner surface 44 of the body 14. The inner screw 30 is located inside a sleeve 42 which is removable and reversibly mounted on the inner surface 44 of the body 14.

Alternatively, the blades 32 of the inner screw 30 may be mounted to the inner surface 44 of the body 14. The body 14 therefore has an outer screw 22 located on its outer surface 20 and an inner screw 30 located within the body 14.

In use, the apparatus may be inclined relative to the horizontal and/or vertical plane so that the fluid outlet and upper end of the tubes containing the internal screws are above the level of the flowing drive water whereas the outer screw on the surface of the body is in contact with the flowing water. The fluid inlet and lower end of the tubes are submerged or partially submerged in the water so that as the apparatus rotates water can be drawn up by the rotation of the inner screws through the internal tubes to exit the fluid outlet.

In one embodiment, the screw apparatus 10 may be positioned in a channel, tube or half tube casing. The channel may have a semi-circular shape. The inner surface of the channel is adjacent to the peaks 27*a* of the blades 24 such that the screw apparatus 10 is free to rotate around its longitudinal axis within the channel.

The channel is configured to direct the flow stream of water to act upon outer helical screw whilst protecting the helical blades from contacting objects such as stones on the river bed that may prevent the assembly from rotating. The flow stream may pass through the space between the channel and the body 14 thereby contacting the blades of the outer screw causing the apparatus to rotate.

Various combinations of the inner and outer screws are possible including multiple sets of helical screws having one or more blades located inside the body 14. The two different screws can comprise multiple sets of helical blades or a combination of blades and helical coiled tube, sleeves or tubes.

The inner and outer screws are assembled in a generally cylindrical or preferably conical configurations so that although they revolve in the same direction about their common axis, the rotation causes fluid in contact with the opposite directional screw blades to flow in opposing directions when the outlet is upstream of the inlet. When the outlet is downstream of the inlet the fluid flows in the same direction.

Figure 3:
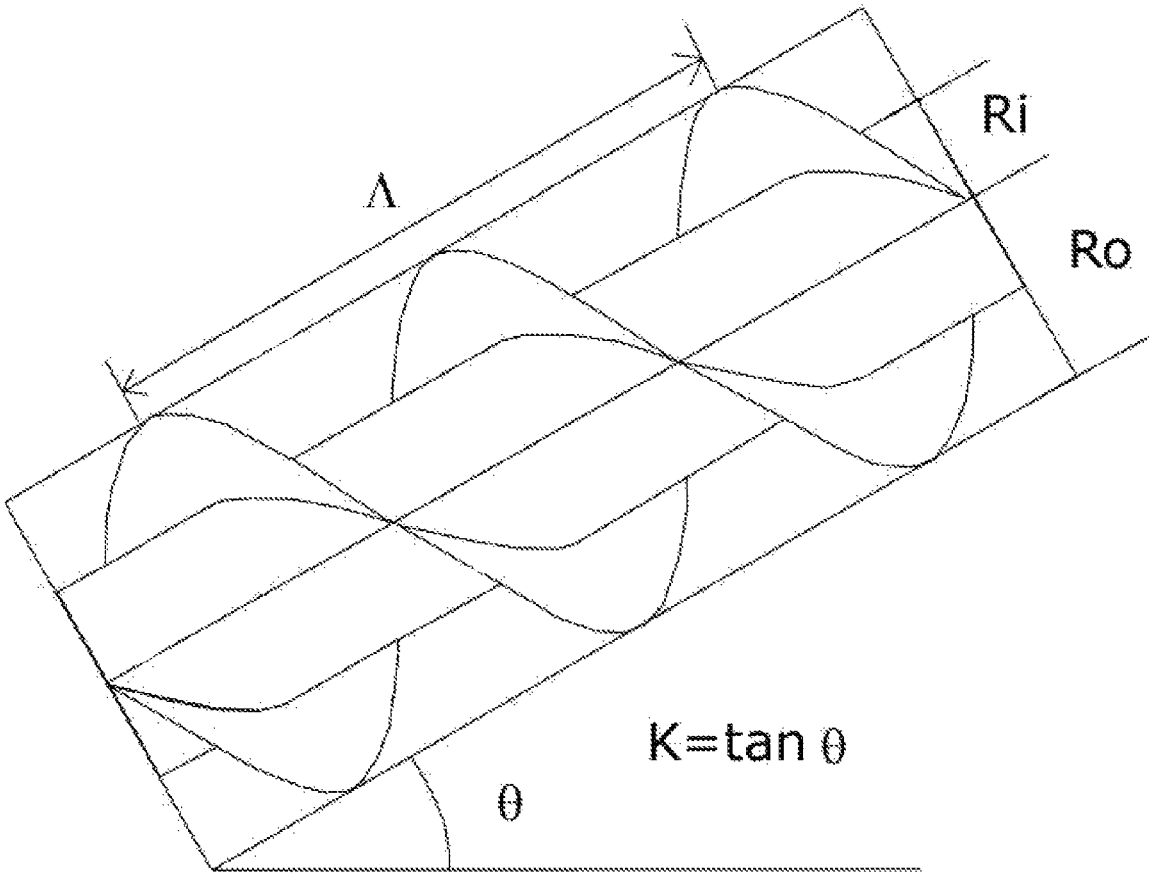
FIG. 3 is a schematic drawing of an Archimedes screw in an inclined operation configuration showing the parameters used to optimise the pump apparatus screw pump apparatus of FIG. 1.

The performance of the pump apparatus when used in an inclined configuration can be optimised by considering a number of design parameters as shown in FIG. 3. The number of blades (n), the screw blade radius ratio (ρ), the pitch of the screw (Λ), the pitch ratio of the screw (λ) and the slope of the screw (K).

The equations that can be used to relate the various parameters to optimise the performance of the Archimedes screw are:

$$\rho^*=Ri/Ro(0\leq\rho\leq1)$$

where ρ* is the optimal radius ratio (which has known values for different values of n for example ρ*=0.5353 when the number of blades (n)=6) Ro is the outer radius of the blade and Ri is the inner radius of the blade (the optimum Archimedes screw is usually located around a central cylindrical axis that has a radius of Ri)

$$\lambda=K\Lambda/2\pi Ro(0\leq\lambda\leq1)$$

where λ is the pitch ratio and λ* is the optimal pitch ratio which has a known value for each value of n (for example when n=6, λ*=0.2763 and Λ is the pitch or period of one blade in metres (the length required for one 360° rotation of the blade) and (0≤Λ≤2πRo/K) and $$K=\tan\theta$$

where θ is the angle of slope of the Archimedes Screw.

For example, to optimise the design of an inner screw for a given application an outer radius for the screw with the desired number of blades is chosen and then the inner radius can be calculated which gives the required radius of the inner cylinder axle which supports the screw.

The optimal pitch ratio is known and can be used to calculate the pitch of the screw depending on the required slope of the screw which can be calculated from the particular location depending on the desired height that water needs to be lifted by the screw from the body of water.

The outer screw which is used to provide rotation to the apparatus can be designed using the same principles as the inner screw using the same equations as above and the known inner radius of this screw which is equivalent to the outer radius (Ro) of the inner screw plus the wall thickness separating the inner and outer screw.

The optimum performance of the screw in terms of flow rate of pumped water may require that the rate of rotation is less than potentially provided by the outer screw in which case the outer radius of the screw could be lessened or a tapered outer screw could be provided as a sliding sleeve so that the rotation rate is adjustable by increasing or decreasing the surface area of the blades exposed to water depending on the flow rate and level of water in the river.

Figure 4:
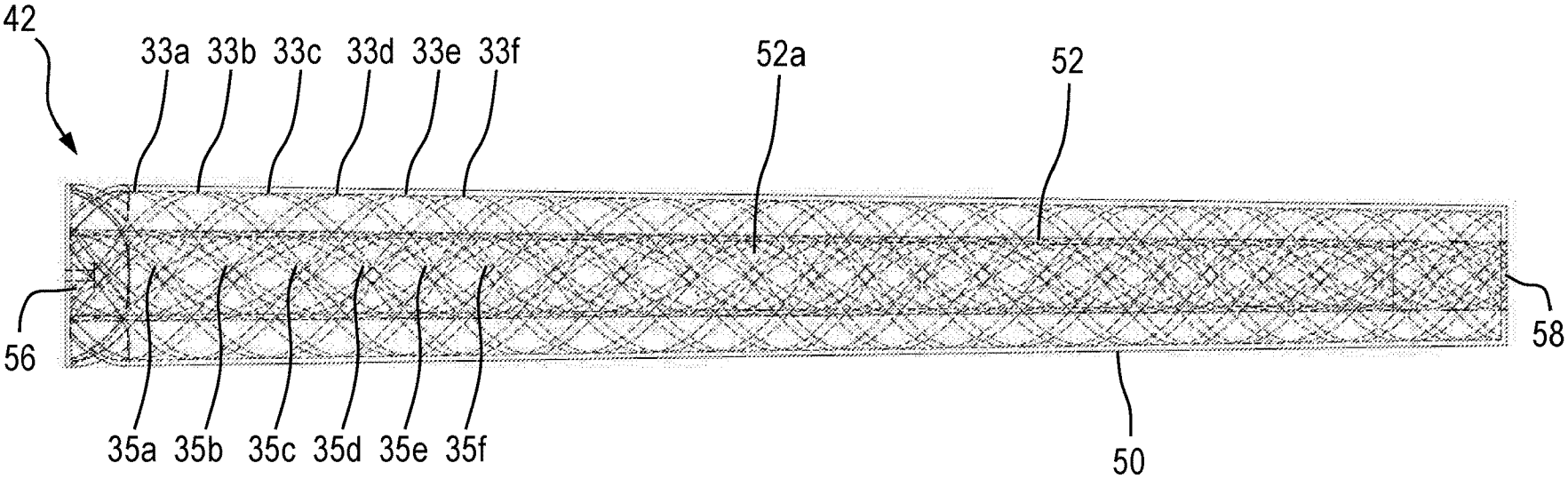
FIG. 4 shows a wireframe side view of the insert sleeve of the screw pump apparatus of FIG. 2.

FIG. 4 shows the sleeve 42 removed from the apparatus 10. The sleeve is removable and reversibly mounted on the inner surface of the body 14 so that the sleeve and body 14 are co-axial and are rotationally coupled as best shown in FIG. 2.

The sleeve comprises an outer body 50, a central shaft 52, a fluid inlet 56 and a fluid outlet 58. The fluid inlet channel is in fluid communication with the inlet opening on the outer body (not shown). The central shaft 52 has a plurality of helical blades 33 located on an outer surface 52*a* to form an inner screw 30. In this embodiment six blades 33*a* to 33*f* are located on the central shaft 52. In the wireframe drawing of FIG. 4, the outline of where each of the base of the blades 33*a* to 33*f* connects to the central shaft 52 is shown as 35*a* to 35*f*. The blades 33*a* to 33*f* may be fixed to or integral with the outer surface 52*a* of central shaft 52.

In other embodiments, multiple inner screws may be arranged inside the body 14. As an example, the central shaft may be hollow and house a further inner screw around an inner surface. A further alternative arrangement of the inner screws is described in relation to FIG. 5 below.

Figure 5A:
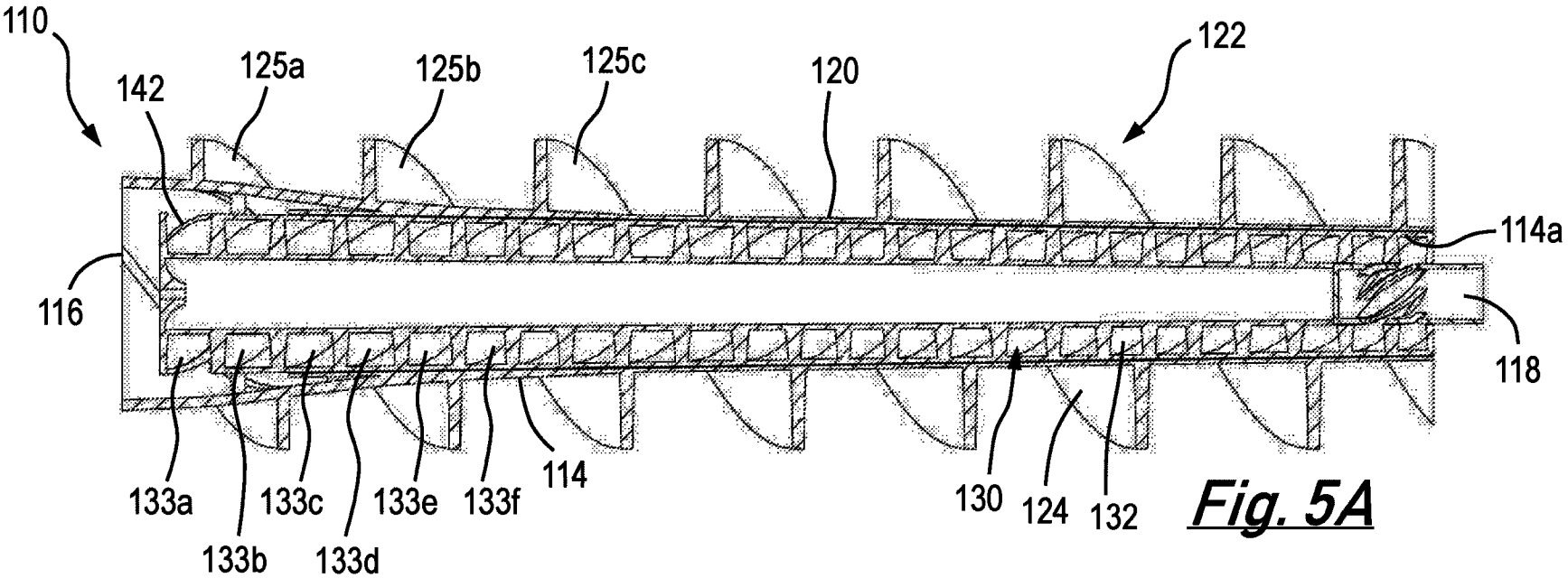
FIG. 5 shows a sectional drawing of a screw pump apparatus operated in substantially horizontal position to pump a head of water in accordance with an embodiment of the present invention.
Figure 5B:
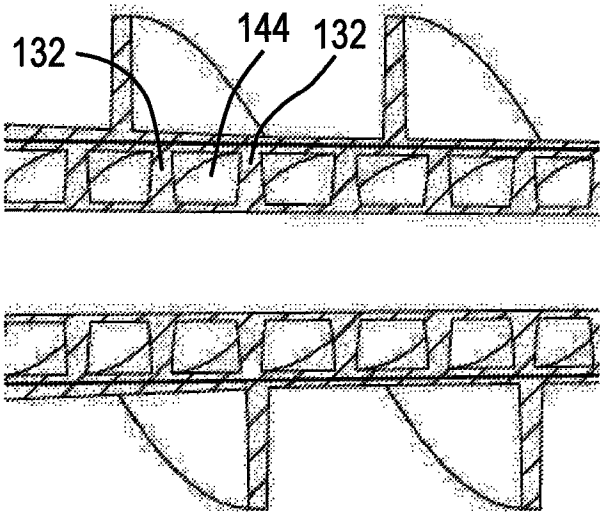

As shown in FIGS. 5A and 5B, the apparatus 110 may be orientated substantially horizontally in a stream of flowing water to provide a head of water which is pumped out of the apparatus allowing the pumped water to be transported away from the water source to a desired destination or positioned over a channel to collect and transport the water.

The screw apparatus 110 may be operated in a horizontal arrangement and pump water to a higher level than the water level of a river. This avoids the need to provide a supporting dam structure and allows the pump to operate on any river.

The apparatus 110 has a similar structure and configuration to the apparatus 10 described in FIGS. 1 and 2 and will be understood from the above description of FIGS. 1 and 2 above.

The apparatus 110 comprises a body 114, a fluid inlet 116 and a fluid outlet 118. The body 114 has an outer surface 120 and an outer screw 122 formed from a plurality of helical blades 124 located on the outer surface 120. The screw apparatus 110 is configured to rotate around its longitudinal axis when a fluid passes over the surface of the outer surface 120 and the outer screw 122. In this example three blades 125*a*, 125*b* and 125*c* are located on the outer surface 120 in a helical threaded arrangement.

An inner screw 130 is located inside the body 114. The inner screw 130 is configured to be in fluid communication with the fluid inlet 116 and fluid outlet 118. The inner screw 130 is formed from a plurality of helical blades 132 located on the inner surface 121 of the body 114. In this example six blades 133*a*, 133*b*, 133*c*, 133*d*, 133*e* and 133*f* are located in a sleeve 142. The outer screw 122 and the inner screw 130 are co-axial and are rotationally coupled. The threads of the outer screw 122 and inner screw 130 have opposing directions.

By providing three blades or more blades on the inner screw 130, the sets of blades are separated from each other forming discrete flow channels as the blades are rotated discrete pockets 144 are created between the blades 133*a* to 133*f* which prevents the air space along the length of the screw contained within the casing forming a continuous connected volume from the inlet 116 to the outlet 118.

The discrete pockets are created in each 360-degree section of the inner screw 130 which are defined by the pitch or period of the blade 125*a*, 125*b* and 125*c*. Each revolution of the inner screw 130 takes air and water in to the discrete pockets. Each revolution of the inner screw causes consecutive pockets 144 comprising air and water to travel along the screw 130.

The inner screw is configured to have a decreasing internal volume from the inlet 116 to the outlet so that the discrete pockets 144 within each blade revolution occupy a progressively decreasing volume along the longitudinal length of the inner screw 130 thereby compressing the air portion of the air and water mixture taken into the inner screw. This allows pressure to be built up within the trapped air and water pockets and a head of water to be created by the apparatus 110.

The internal volume may be reduced in various ways by progressively increasing the inner radius of the inner blades whilst maintaining a constant outer radius of the inner blades, or by decreasing the outer radius of the inner blades whilst maintaining the inner radius of the inner blades. The internal volume may alternatively be reduced by reducing the pitch of the blades as the outlet is approached. In general, the volume of the discrete pocket at the last screw rotation before the outlet is half that of the discrete pocket at the first rotation at the inlet. The head of water produced by the pump is also dependent on the number of revolutions of screw within the length of the pump. The pump that produces a head of water requires a rotating coupling to transport the water from the rotating pump to a static pipe that takes the water away from the river.

In this example the inner surface 114*a* of the apparatus body 114 is tapered to become gradually narrower to progressively decrease the volume of the air pockets. Alternatively, or additionally the helical blades may be tapered to become gradually larger or narrower and/or the central shaft may be tapered to become gradually narrower or wider or to gradually decrease the pitch of the screw.

As water and air are conveyed along the diminishing volume of the screw passage from the inlet 116 to the outlet 118, the water and air will be forced to occupy a successively smaller space with each revolution of the screw.

In operation, the inlet 116 and inner screw 130 is generally half-submerged in water, the volume of water and air taken into the inner screw is about 50:50. In this case as long as the screw dimensions at the outlet has a volume equivalent to half that of the screw dimension at the inlet then the air pockets within the inner screw are compressed with each rotation of the screw that allows the water to exit the pump under pressure.

The pressure created within the inner screw 130 depends on the number of threads of the screw along its length, the larger the number of threads and therefore air pockets, the greater the pressure and the greater the head of water can be achieved as the water exits the pump.

Because the inner screw takes water and air successively into the inlet as it rotates, water and air flow from the outlet. The compressed air pockets not only push the water through the inner screw and any connected horizontal piping, but if the water needs to be delivered at a raised elevation the low-density air pockets assist the water to flow up an inclined pipe because of the difference in density between the water and the air.

The dimensions of the screw adjacent to the outlet should result in a volume that is be no less than half the volume of the screw adjacent to the inlet in order that the inner flow volume of the screw is sufficient to contain the non-compressible water taken into the apparatus.

The available space for the water and air taken in at the inlet decreases as the water and air pass along the screw. The idea is that as the water is incompressible there is sufficient volume provided in each pitch segment to contain the inlet water, but the air being compressible is forced to occupy a successively decreasing volume with each rotation. The compressed air pockets impart pressure within the internal screw which is dependent on the number of threads in the system. Water can be made to rise to a considerable height above the level of the river as it exits the pump. The limitation on this system is that the volume of the final thread must be sufficient to hold the volume of water that enters the first thread, otherwise the pressurised water will blow back out of the inlet.

The head of water produced by the pump can be designed depending on the application and the competing needs of water flow and head of water. In the case where water is being removed from the river at a potential area of flooding and pumped back into the river downstream of that area then the head of water required is just that required to raise the water to a sufficient height to clear the river bank and allow the water to be piped over the flood plain and back into the river downstream of an area that might otherwise become flooded. In this case the rate at which water can be pumped is the most critical factor in flood prevention and an Archimedes screw with as few as four rotations may be sufficient to lift the water high enough to remove the water from the river.

The equations describing the use of the apparatus in a horizontal pumping configuration can be expressed as:

$D=h_1$=diameter of the inner screw when the water level touches the inner screw of the apparatus H=Delivery Head, n=number of screw thread revolutions, d=screw flow channel diameter, $h_n$=head in the nth screw thread revolution.

From Boyles Law $P_1V_1=P_nV_n$

If $P_1=P_{atm}+D$ and $V_1$=air volume in the first or outer screw thread revolution, then $P_n=P_{atm}+H$ and $V_n$=air volume in the last or inner screw thread revolution.

The volume of the first or outer screw thread and the volume of the last or inner screw thread can be calculated using (pi×r^2×l) where r is d/2 (half the pipe diameter d) and "l" is related to D, h1 and hn.

Figure 6:
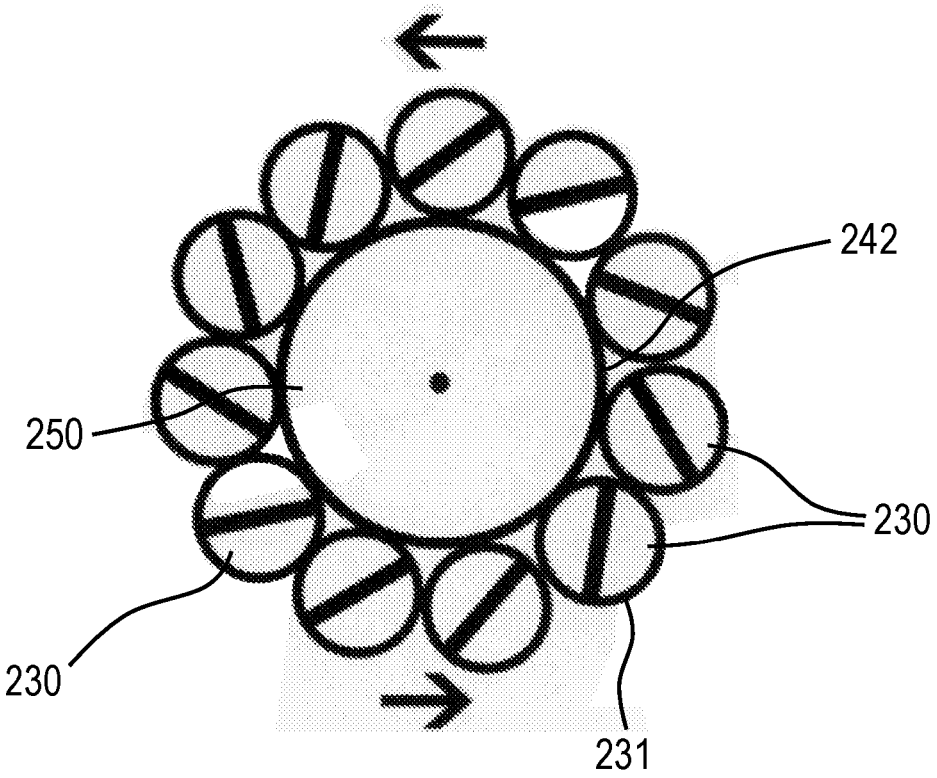
FIG. 6 shows an alternative insert sleeve comprising a rotatable pump member for the screw pump apparatus of FIG. 2, shown in profile end view.

FIG. 6 shows an alternative configuration of an inner sleeve 242 for the fluid pump apparatus. The sleeve comprises a rotatable pump member consisting of multiple screw members 230 located around and parallel to a central longitudinal axis rather than the previous examples where the inner and outer screw member are coaxial. FIG. 6 shows a profile view of eleven screw members arranged in a cylindrical manner whose axis of rotation is around the central longitudinal axis of the cylinder as opposed to the central longitudinal axis of the individual rotatable pump members.

The sleeve 242 comprises a cylindrical outer body 250 with a plurality of screws 230 mounted within cylindrical or conical tubes 231 which are fixed to outer circumference of the outer body 250. The sleeve and plurality of screws are configured to rotate about the central longitudinal axis of the sleeve 242. In this example, eleven screws 230 are arranged on the circumference of the outer body 250 of the sleeve. The cylindrical or conical tubes surrounding the screws may be cylindrical or tapered (if a head of water is required).

When assembled the sleeve 242 and plurality of inner screws 230 are located inside the outer body of the apparatus.

The apparatus is configured to rotate around its longitudinal axis when a fluid passes over the outer surface and the outer screw. As the apparatus rotates, the sleeve 242 is rotated about its central longitudinal axis and each screw 230 rotates about 360 degrees about the central longitudinal axis of the sleeve 242 on which the screws are mounted rather than the longitudinal axis of the screw itself.

One end of each of the screws 230 is configured to be in fluid communication with a fluid inlet and the other end of each of the screws is in fluid communication with a fluid outlet. Each revolution of the inner screws 230 takes air and water into the discrete pockets formed between the screw and the cylindrical or conical tubes surrounding the screw. Each revolution of the inner screws causes consecutive pockets comprising air and water to travel along the longitudinal length of the screws to the outlet.

The screws 230 may be arranged around the sleeve 242 in parallel to the rotational axis of the sleeve provided by the central longitudinal axis of the sleeve. Alternatively, the helical screws 230 may be arranged at an angle to the central rotational axis of the sleeve so that water impinging on the tubes containing the screws cause the device to rotate without the requirement for a separate screw member. In another embodiment, the arrangement could be used in the manner of a water wheel where flowing water impinges on the screw cylinders and causes the pump to rotate.

The choice of pump configuration depends on the flow of the body of the water and whether the pump can be set on an incline or whether it will need to operate in a horizontal attitude and also important are the flow rate and head of water required from the pump.

Figure 7A:
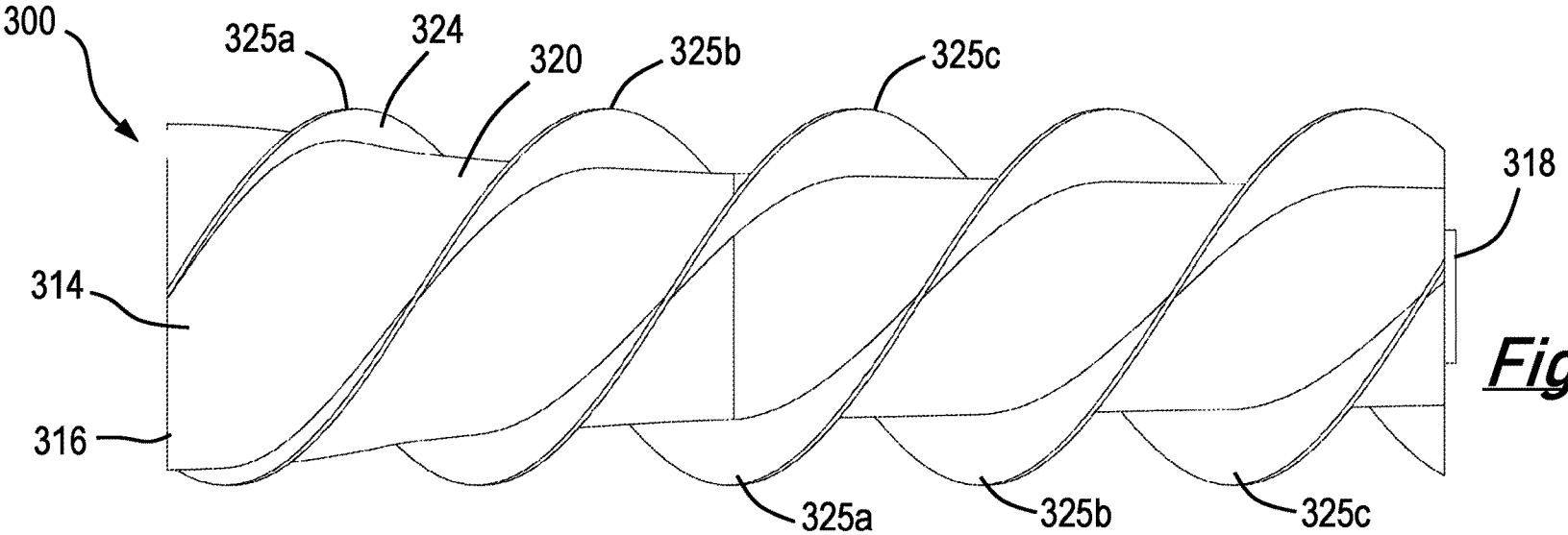
FIGS. 7A and 7B show profile and wireframe views of screw pump apparatus in accordance with an embodiment of the present invention.
Figure 7B:
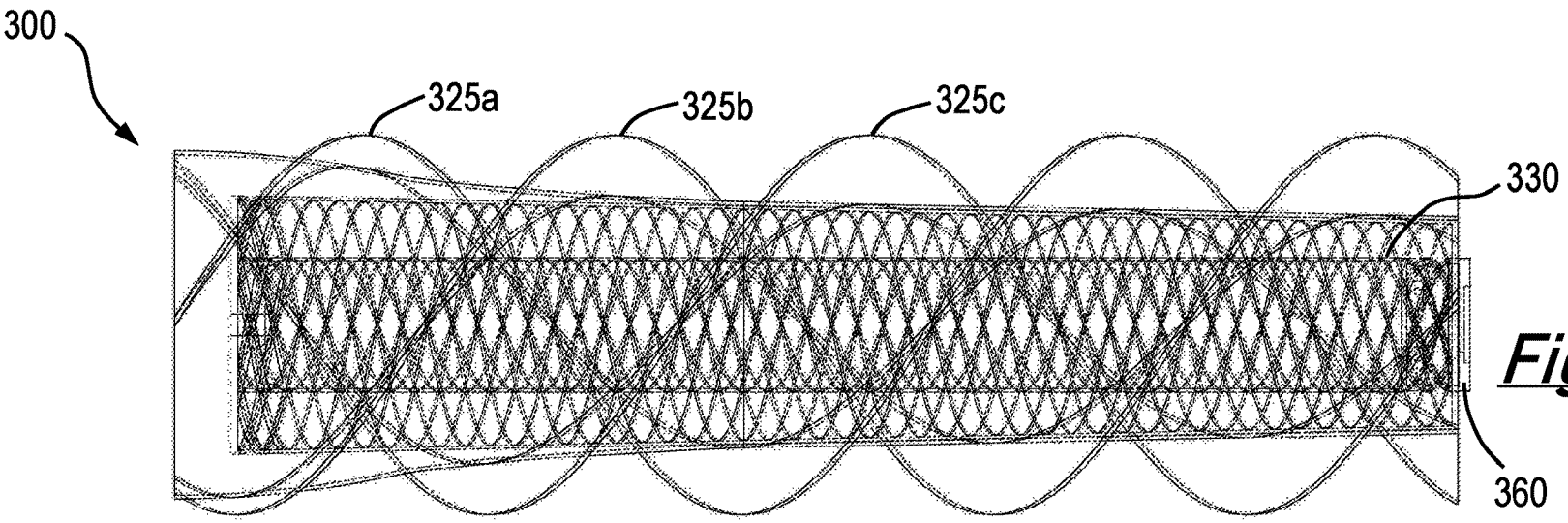

FIGS. 7A and 7B shows profile and wireframe views of an assembled screw pump apparatus 300. FIGS. 8A to 11A show components of the screw pump apparatus 300.

Figure 8A:
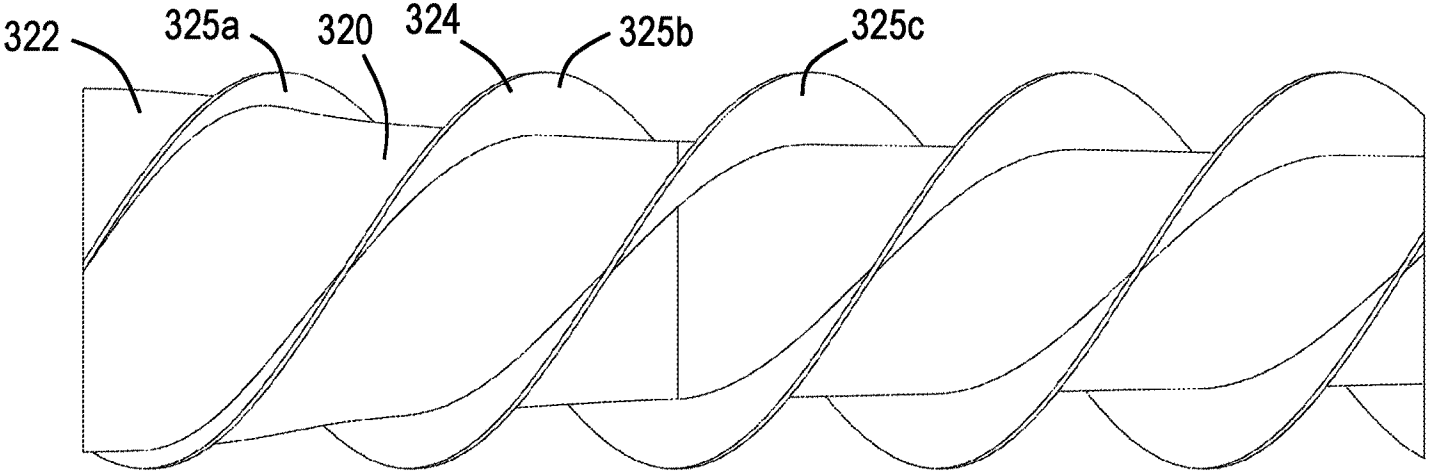
FIGS. 8A and 8B show profile and wireframe views of an outer screw of the screw pump apparatus of FIGS. 7A and 7B.
Figure 8B:
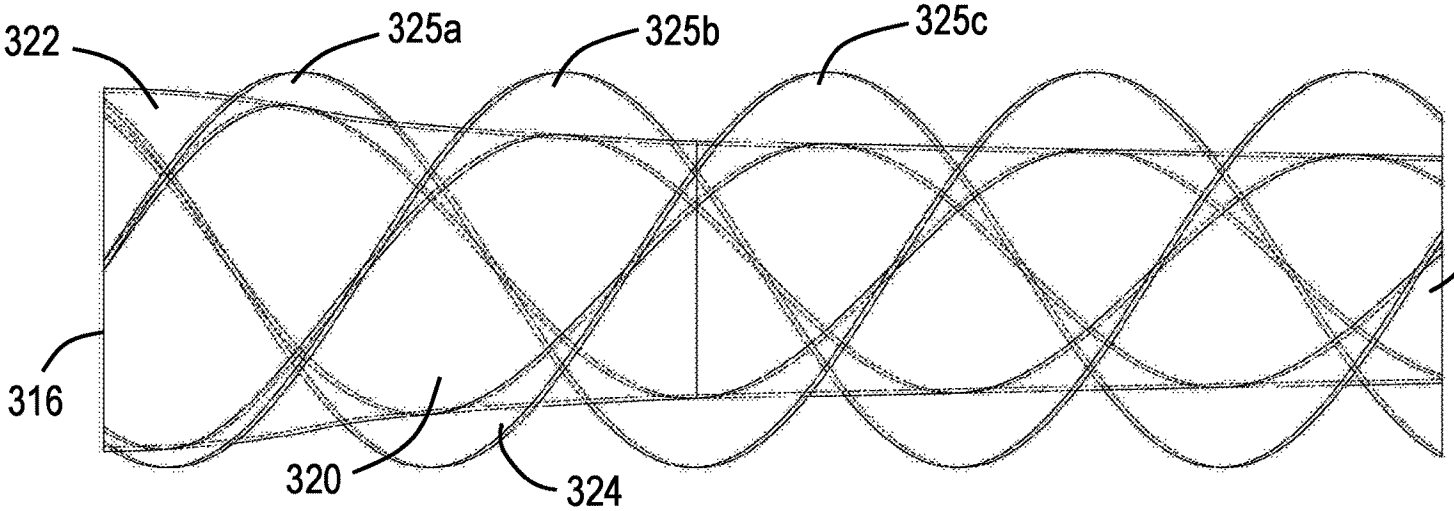

The apparatus 300 comprises a body 314, a fluid inlet 316 and a fluid outlet 318. The body 314 has a generally cylindrical outer surface 320 and an outer screw 322 as shown in FIGS. 8A and 8B, formed from a plurality of helical blades 324 located on the outer surface 320. The blades 324 may be fixed to or integral with the outer surface 320.

The apparatus 300 is configured to rotate around its longitudinal axis when a fluid passes over the outer surface 320 and the outer screw 322. In this example three blades 325*a*, 325*b* and 325*c* are located on the outer surface 320 in a helical threaded arrangement.

Figure 9A:
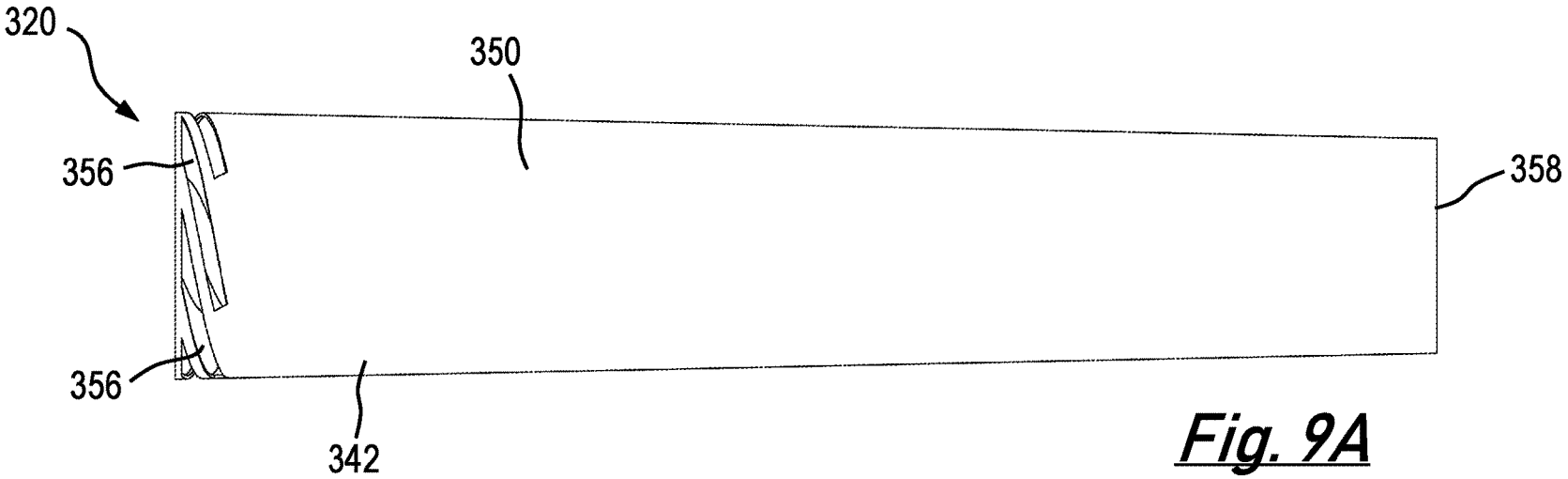
FIGS. 9A and 9B show profile and wireframe views of an inner screw of the screw pump apparatus of FIGS. 7A and 7B.
Figure 9B:
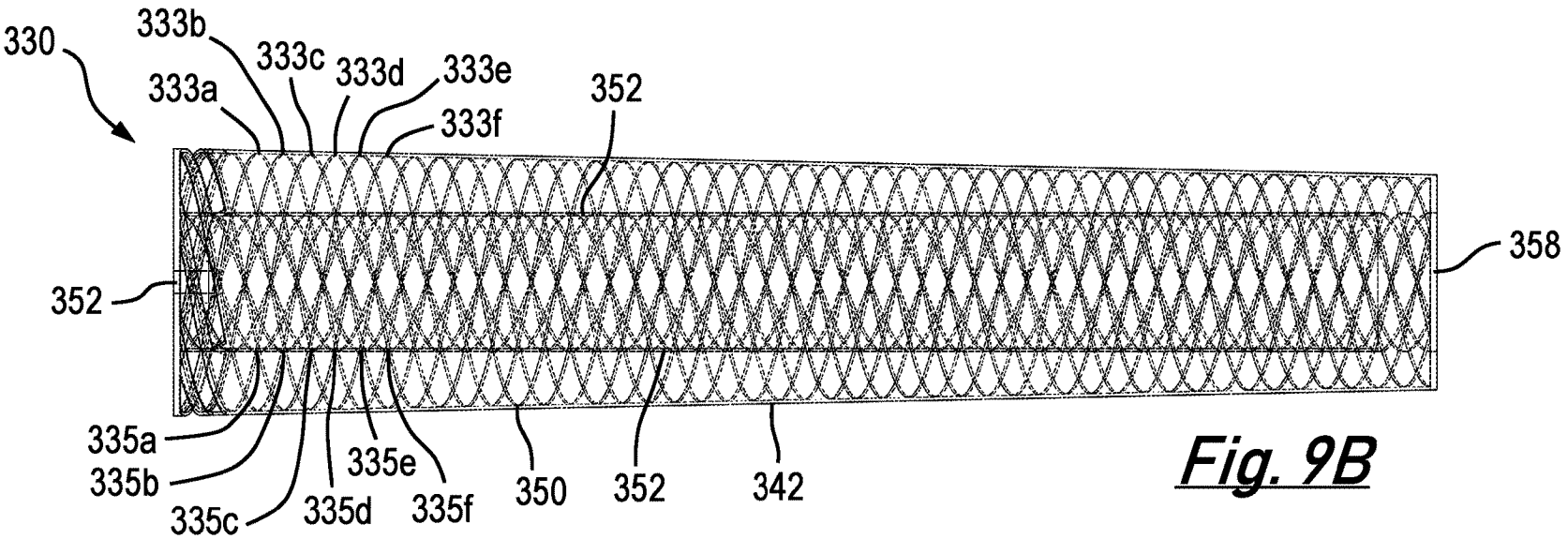

FIGS. 9A and 9B shows an inner screw 330 removed from the apparatus 300. The inner screw 330 is mountable inside the screw pump apparatus 300 so that the outer screw 322 and the inner screw 330 are co-axial and are rotationally coupled as best shown in FIG. 7B. The inner screw 330 has a sleeve 342 with an outer body 350, a central shaft 352, fluid inlet openings 356 and a fluid outlet 358. The fluid inlet channel is in fluid communication with inlet opening 316 on the outer body. The central shaft 352 has a plurality of helical blades 333 located on an outer surface 352*a* which forms the inner screw 330.

In this embodiment six blades 333*a* to 333*f* are located on the central shaft 352. In the wireframe drawing of FIG. 9B, the outline of where each of the base of the blades 333*a* to 333*f* connects to the central shaft 352 is shown as 335*a* to 335*f*. The blades 333*a* to 333*f* may be fixed to or integral with the outer surface 352*a* of central shaft 352.

Figure 10A:
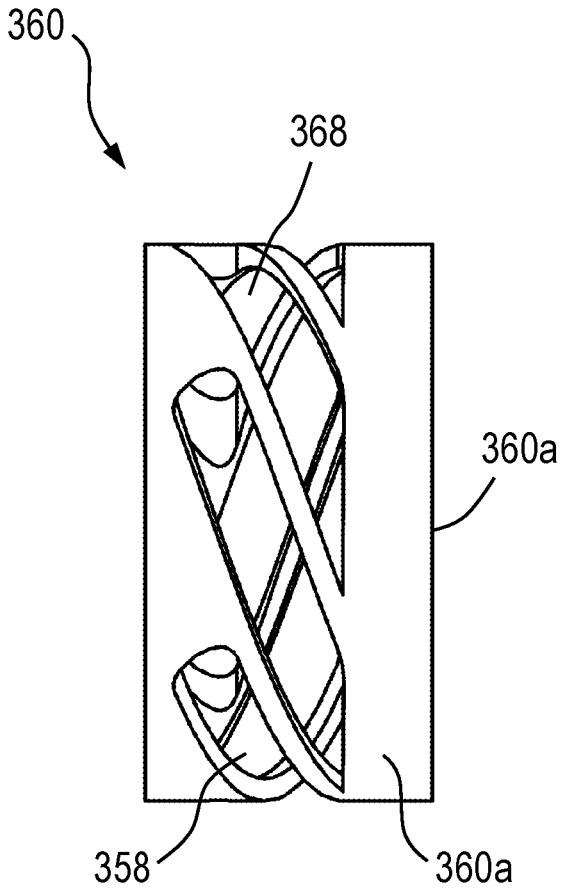
FIGS. 10A and 10B show profile and wireframe views of a screw insert from the screw pump apparatus of FIGS. 7A and 7B.
Figure 10B:
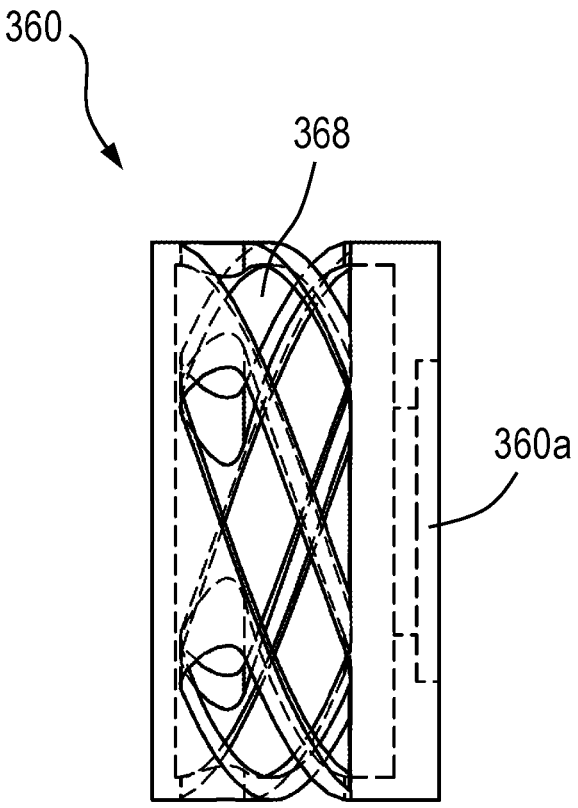
Figure 11A:
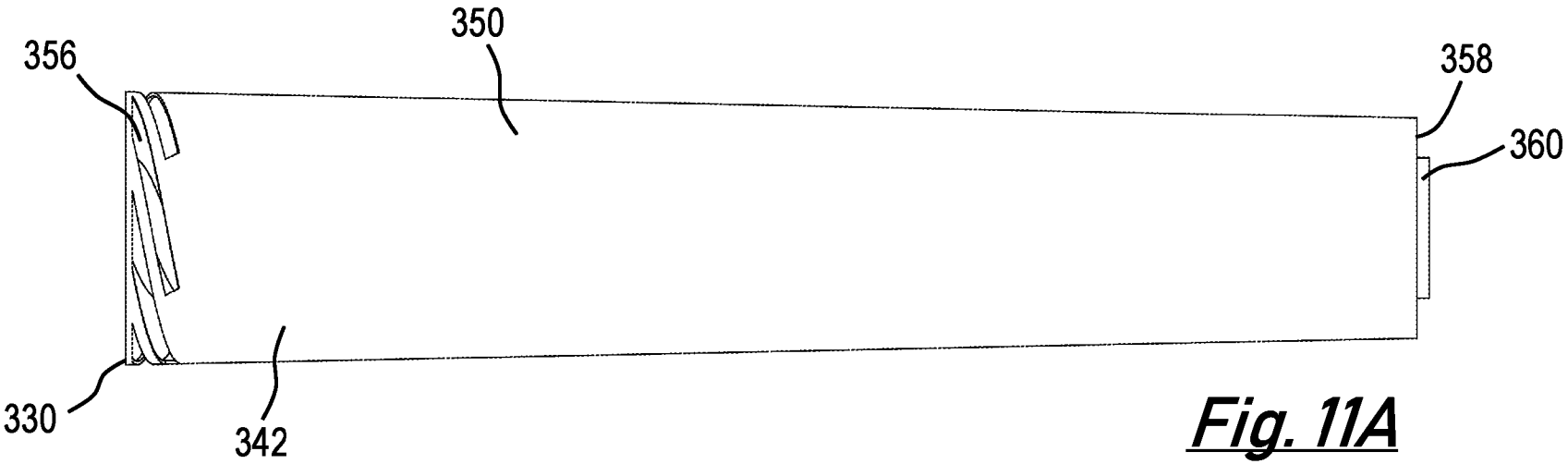
FIGS. 11A and 11B show profile and wireframe views of the inner screw of FIGS. 9A and 9B with screw insert mounted.
Figure 11B:
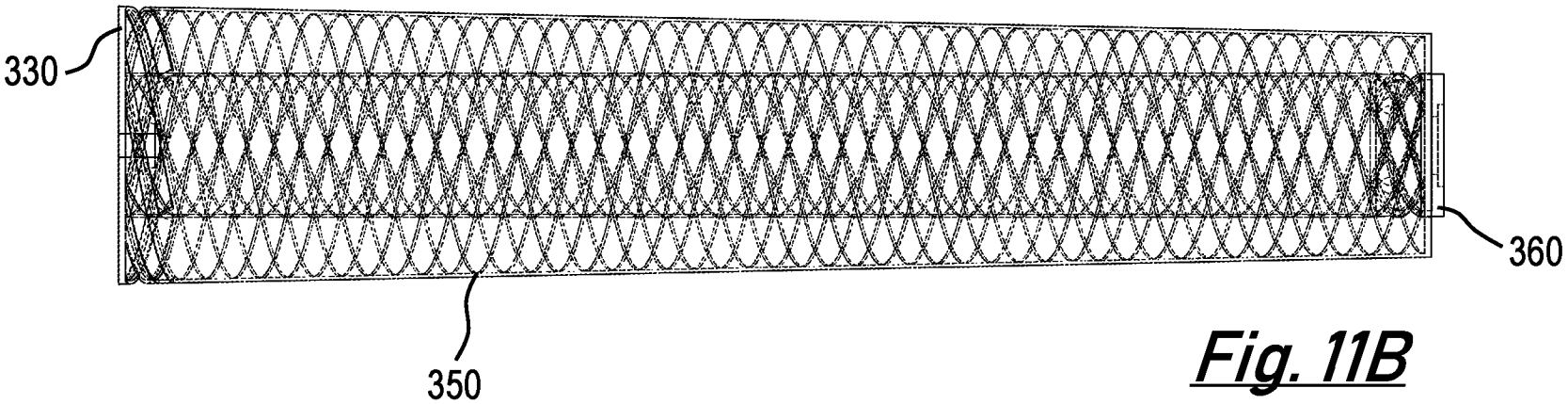

FIGS. 10A and 10B shows an insert 360 which is configured to connect the inner screw 330 to the central shaft 52. The insert has a sealed downstream end 360*a* but has channels 368 which act as outlets to the terminal section of the central shaft and then fluid outlet 318 (which in turn is connected to an outlet pipe carrying the water away via a rotating coupling). Flow passes from outlet 358 in the inner screw through channels 368 in the insert 360 and out through the fluid outlet 318

In the above examples the pump apparatus is described as being used to transport or pump water. However, the apparatus may additionally or alternatively be used to generate electricity by connecting the apparatus to a generator such that rotation of the apparatus when exposed to a fluid stream, as described above, rotates the generator to generate electricity.

The invention provides a fluid pump apparatus comprising a fluid inlet, a fluid outlet; a screw member having at least one helical blade and a rotatable pump member. The screw member is located on an exterior surface of the fluid pump apparatus.

The present invention provides a screw pump apparatus with improved reliability and accessibility and which is capable of being powered by a body of moving fluid.

The present invention provides a screw pump apparatus which is capable of reliably displacing fluid in horizontal and inclined configurations.

By providing an outer screw which is located on the surface of the body and an inner located inside the body and rotationally coupled to the outer screw, rotation of the outer screw by a flowing stream of water rotates the inner screw.

The inner screw has a plurality of blades arranged in an opposing helical direction than the plurality of blades of the outer screw. Rotation of the inner screw pumps water from a downstream end of the apparatus in an opposite direction to the direction of the water flow stream acting on the outer screw.

In this manner, the apparatus provides a water pump that has one moving part and the pump requires only flowing water to allow it to function.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "horizontal", "vertical", right hand, left hand and the like are used herein to indicate directions and locations as they apply to the appended drawings and will not be construed as limiting the invention and features thereof to particular arrangements or orientations. Likewise, the term "outlet" shall be construed as being an opening which, dependent on the direction of the movement of fluid may also serve as an "inlet", and vice versa.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

Various modifications to the above described embodiments may be made within the scope of the invention herein intended.

The invention claimed is:

1. A fluid pump apparatus comprising a fluid inlet;

a fluid outlet;

an outer screw member having at least one helical screw blade located on an outer surface of the apparatus configured to rotate the fluid pump apparatus around a longitudinal axis of the apparatus; and a rotatable pump member, wherein the rotatable pump member is at least one inner screw member, each at least one inner screw member having at least one helical blade;

wherein the at least one inner screw member is in fluid communication with the fluid inlet and/or fluid outlet and wherein the outer screw member and the at least one inner screw member are rotationally coupled.

2. The fluid pump apparatus according to claim 1 wherein the outer screw member and the at least one inner screw member are arranged co-axially.

3. The fluid pump apparatus according to claim 1 wherein the outer screw member and the at least one inner screw member are arranged concentrically.

4. The fluid pump apparatus according to claim 1 wherein the at least one inner screw member is configured to pump or displace fluid when it is rotated.

5. The fluid pump apparatus according to claim 1 wherein the at least one inner screw member and/or the outer screw member comprises three or more helical blades.

6. The fluid pump apparatus according to claim 1 wherein the at least one helical blade of the outer screw member has a first thread direction.

7. The fluid pump apparatus according to claim 6 wherein the at least one blade of the at least one inner member has a second thread direction.

8. The fluid pump apparatus according to claim 7 wherein the first thread direction and the second thread direction are in opposing directions, the first thread direction and second thread direction are contra-directional.

9. The fluid pump apparatus according to claim 1 wherein the outer screw member is configured to contact a fluid flow stream.

10. The fluid pump apparatus according to claim 1 wherein a first thread direction of the outer screw member is configured to rotate the fluid pump apparatus around its longitudinal axis when exposed to a fluid flow.

11. The fluid pump apparatus according to claim 1 wherein the at least one inner screw member is located on or in a sleeve mountable on an interior surface of the fluid pump apparatus.

12. The fluid pump apparatus according to claim 1 wherein the thread of the at least one inner screw is configured to generate a flow or movement of fluid along an axial length of the at least one inner screw member when the at least one inner screw member and/or the outer screw member is rotated.

13. The fluid pump apparatus according to claim 1 wherein a fluid flow stream acting upon the outer screw member in a first flow direction rotates the at least one inner screw member and creates a flow of fluid in a second flow direction.

14. The fluid pump apparatus according to claim 13 wherein the first flow direction and the second flow direction are opposing flow directions.

15. The fluid pump apparatus according to claim 13 wherein the direction of flow of the first flow direction and/or the second flow direction depends on whether the inlet is upstream or downstream of the outlet.

16. The fluid pump apparatus according to claim 1 wherein the inlet and outlet are axially spaced apart along the longitudinal axis of the body.

17. The fluid pump apparatus according to claim 1 wherein a body of the apparatus converges or tapers along its longitudinal axis toward the outlet.

18. A method of pumping a fluid, the method comprising providing a fluid pump apparatus comprising:

a fluid inlet;

a fluid outlet;

an outer screw member having at least one helical blade located on an outer surface of the apparatus;

at least one inner screw member having at least one helical blade;

wherein the at least one inner screw member is in fluid communication with the inlet and/or the outlet;

wherein the outer screw member and the at least one inner screw member are rotationally coupled;

exposing the apparatus to a body of moving fluid to rotate the outer screw member; and;

moving the at least one inner screw member to move fluid from the fluid inlet to the fluid outlet.

19. The method according to claim 18 comprising submerging or at least partially submerging the apparatus in the body of moving fluid.

20. The method according to claim 18 comprising rotating the outer screw member in a first flow direction to rotate the at least one inner screw member and create a flow of fluid in a second flow direction.

21. An irrigation system or a flood control system comprising a fluid pump apparatus comprising:

a fluid inlet;

a fluid outlet;

an outer screw member having at least one helical blade located on an outer surface of the apparatus; and at least one inner screw member having at least one helical blade, wherein the at least one inner screw member is in fluid communication with the fluid inlet and/or the fluid outlet; and wherein the outer screw member and the at least one inner screw member are rotationally coupled.

22. The fluid pump apparatus according to claim 1 wherein the at least one inner screw is configured to have a decreasing internal volume from the inlet to the outlet.

23. The method according to claim 18 comprising pumping a fluid in a substantial horizontal direction.

24. The method according to claim 18 comprising moving consecutive pockets of air and water along the rotatable pump member from the inlet to the outlet.

25. The method according to claim 24 comprising building pressure within the discrete air pockets and creating a head of water.

* * * * *